US006606061B2

(12) United States Patent
Wong et al.

(10) Patent No.: US 6,606,061 B2
(45) Date of Patent: Aug. 12, 2003

(54) BROADBAND CIRCULARLY POLARIZED PATCH ANTENNA

(75) Inventors: Kin-Lu Wong, Kaohsiung (TW); Fa-Shian Chang, Kaohsiung (TW); Tsung-Wen Chiu, Taipei (TW)

(73) Assignee: Accton Technology Corporation (TW)

( * ) Notice: Subject to any disclaimer, the term of this patent is extended or adjusted under 35 U.S.C. 154(b) by 0 days.

(21) Appl. No.: 09/989,282

(22) Filed: Nov. 20, 2001

(65) Prior Publication Data

US 2003/0063031 A1 Apr. 3, 2003

(30) Foreign Application Priority Data

Oct. 3, 2001 (TW) ..... 90124456 A

(51) Int. Cl.[7] ..... H01Q 1/38
(52) U.S. Cl. ..... 343/700 MS; 343/846
(58) Field of Search ..... 343/700 MS, 702, 343/846, 848

(56) References Cited

U.S. PATENT DOCUMENTS 4,291,311 A * 9/1981 Kaloi ..... 343/700 MS
4,791,423 A * 12/1988 Yokoyama et al. .. 343/700 MS
4,847,625 A * 7/1989 Dietrich et al. ..... 343/700 MS
5,872,542 A * 2/1999 Simons et al. ..... 343/700 MS
6,166,694 A * 12/2000 Ying ..... 343/700 MS

* cited by examiner

*Primary Examiner*—Tan Ho
(74) *Attorney, Agent, or Firm*—Baker Botts LLP

(57) ABSTRACT

A broadband circularly polarized patch antenna is disclosed. The broadband circularly polarized patch antenna consists of: an L-shaped ground plane consisting of a vertical ground plane and a horizontal ground plane; a radiating metal patch; a probe feed placed coplanarly with the radiating metal patch and connected to the radiating metal patch through the vertical ground plane; and a substrate between the radiating metal patch and the horizontal ground plane. Because the probe feed of the broadband circularly polarized patch antenna of the present invention is placed coplanarly with the radiating metal patch, the required length of the probe feed is greatly reduced and the probe inductance effect on antenna's impedance matching is thus decreased, leading to enhanced circular polarization operating bandwidth. In addition, the broadband circularly polarized patch antenna of the present invention has the features of low cost, high antenna gain, good circular polarization radiation and simple structure. Therefore, the present invention is a valuable implementation in industrial fields.

17 Claims, 9 Drawing Sheets

BROADBAND CIRCULARLY POLARIZED PATCH ANTENNA

FIELD OF THE INVENTION

The present invention relates to a broadband circularly polarized (CP) patch antenna. More particularly, it relates to a broadband circularly polarized patch antenna with a probe feed placed coplanarly with the radiating metal patch. Therefore, the inductance effect caused by a longer probe feed in thicker medium, such as air, will be decreased, and a circularly polarized patch antenna with the property of broadband operation, high gain, low cost and simple structure can be obtained.

BACKGROUND OF THE INVENTION

To follow the advancement of the communication technology, the applications using communication technologies have been increased significantly and the related products have become more diversified. The design and study of antenna is more important, because an antenna is used to receive or deliver signals in communication products. In wireless communication, the properties of broadband operation and circular polarization are among the mainstream for the antenna design. Broadband operation can increase the transmission capacity and the transmission speed, and the property of circular polarization can decrease or avoid the multi-path reflection interference from the ambiance. Therefore, in wireless communications, the antenna with the features of broadband operation and circular polarization can be found in many applications, especially when the antenna has a high gain and can be constructed with low cost.

Referring to FIG. 1, FIG. 1 shows a 3D diagram of the structure of conventional rectangular patch antenna with a thick air substrate. In FIG. 1, a probe feed 20 of the conventional rectangular patch antenna with a thick air substrate (reference antenna) is connected with a radiating metal patch 25 from a ground plane 10 through a substrate (such as an air substrate) 15 that is between the radiating metal patch 25 and the ground plane 10, and a signal is fed to the radiating metal patch 25.

In order to obtain an antenna with high gain and broadband operation, the conventional method is to increase the thickness of the substrate 15, so that the quality factor of the antenna will be decreased to increase the radiation efficiency and the operating bandwidth of the antenna. Referring to FIG. 2, FIG. 2 is a diagram showing measured return loss of the conventional reference antenna (the center frequency is 1800 MHz). The dotted line 70 shown in FIG. 2 is a reference line indicating a 14 dB return loss or 1:1.5 VSWR (Voltage Standing Wave Ratio). The curve 50 indicates the impedance bandwidth that is measured from the reference antenna with 3 mm of the thickness of the substrate. The curve 55 indicates the impedance bandwidth that is measured from the reference antenna with 6 mm of the thickness of the substrate. The curve 60 indicates the impedance bandwidth that is measured from the reference antenna with 9 mm of the thickness of the substrate. The curve 65 indicates the impedance bandwidth that is measured from the reference antenna with 13 mm of the thickness of the substrate.

The impedance bandwidth of the antenna increases with the increase of the thickness of the substrate 15. However, as shown in FIG. 2, the return loss of the conventional reference antenna with 6 mm of the thickness of the substrate 15 is better than that with 9 mm and 13 mm of the thickness of the substrate 15, because a longer probe feed 20 is required for transmitting signals to the radiating metal patch 25 when the thickness of the substrate 15 increases. Therefore, the inductance effect caused by the longer probe feed 20 increases, because the probe feed 20 is connected with the radiating metal patch 25 through the substrate 15. Thus, the impedance matching is degraded, and the operating bandwidth of the antenna will be decreased.

In the other way, there are two known methods to achieve circular polarization operation. One is a single-feed method, and the other is a dual-feed method. However, for a conventional single-feed circularly polarized patch antenna, the 3-dB axial-ratio circular polarization bandwidth is not easy to be 3% above; i.e., the operating bandwidth of the aforementioned antenna is narrow so that its practical applications are limited. For a dual-feed circularly polarized patch antenna, a better 3-dB axial-ratio circular polarization bandwidth can be obtained; i.e., the operating bandwidth is wider, but it needs an external phase shifter circuitry, which makes the antenna design complicated and also increases the construction cost of the antenna. Therefore, in order to resolve the aforementioned problem, a circularly polarized patch antenna with high gain, wide band, low cost and simple design has to be provided.

SUMMARY OF THE INVENTION

In view of the background of the invention described above, the inductance effect caused by the long probe feed of the conventional reference antenna affects the impedance matching of the antenna. Moreover, the bandwidth of the conventional single-feed circularly polarized patch antenna is narrow, and the design of the conventional dual-feed circularly polarized patch antenna is complicated and the construction cost is high. Therefore, the conventional circularly polarized patch antenna does not have the features of low cost and wide operating bandwidth, so that the applications thereof are limited.

It is the principal object of the present invention to provide a broadband circularly polarized patch antenna. By using a probe feed placed coplanarly with the patch to convey signals directly to the radiating metal patch, the inductance effect caused by the long probe feed in the thick substrate can be decreased, and the impedance bandwidth can be increased. Through the study data, it is known that the broadband circularly polarized patch antenna of the present invention has the features of low cost, high antenna gain, wide operating bandwidth and good CP radiation, thereby overcoming the disadvantages of the conventional circularly polarized patch antenna.

In accordance with the aforementioned purpose of the present invention, the present invention provides a broadband circularly polarized patch antenna. The broadband circularly polarized patch antenna of the present invention consists of: an L-shaped ground plane; a radiating metal patch; a probe feed placed coplanarly with the radiating metal patch used to connect with the vertical ground plane and the radiating metal patch; and a substrate. In the broadband circularly polarized patch antenna of the present invention, the signal is directly fed to the radiating metal patch by using the probe feed placed coplanarly with the radiating metal patch, and the probe feed does not pass through the thick substrate so that the probe feed can have a smaller length, which decreases the probe inductance and makes better impedance matching easy to obtain. Moreover, the broadband circularly polarized patch antenna of the present invention has the features of high antenna gain, wider operating bandwidth, good circular polarization radiation and simple structure, so that the present invention is a valuable implementation in industrial fields.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
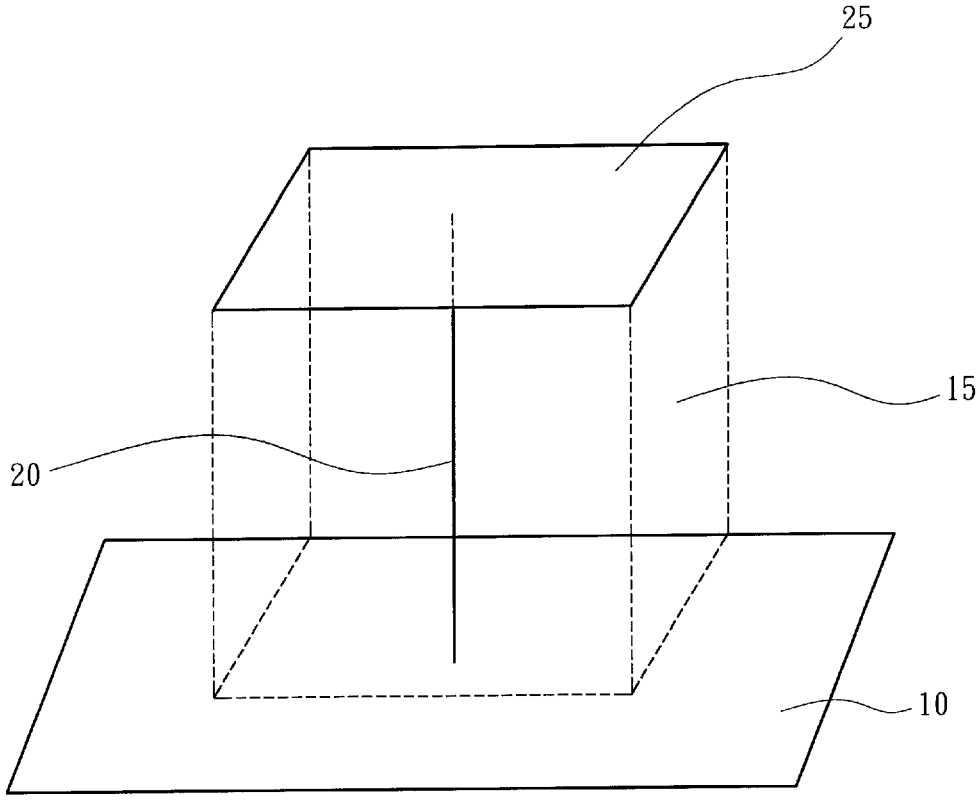
FIG. 1 (PRIOR ART)
FIG. 1 is a 3D diagram of the structure of a conventional rectangular patch antenna with a thick air substrate.
Figure 2:
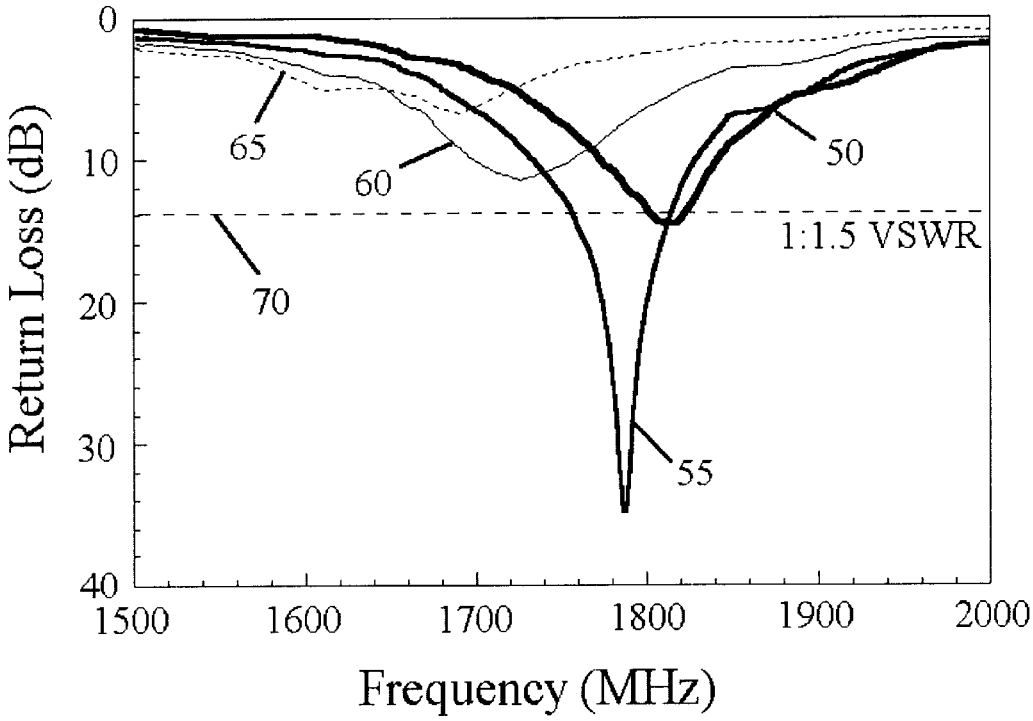
FIG. 2 (PRIOR ART)
FIG. 2 is a diagram showing measured return loss of a conventional reference antenna (the center frequency is 1800 MHz).
Figure 3:
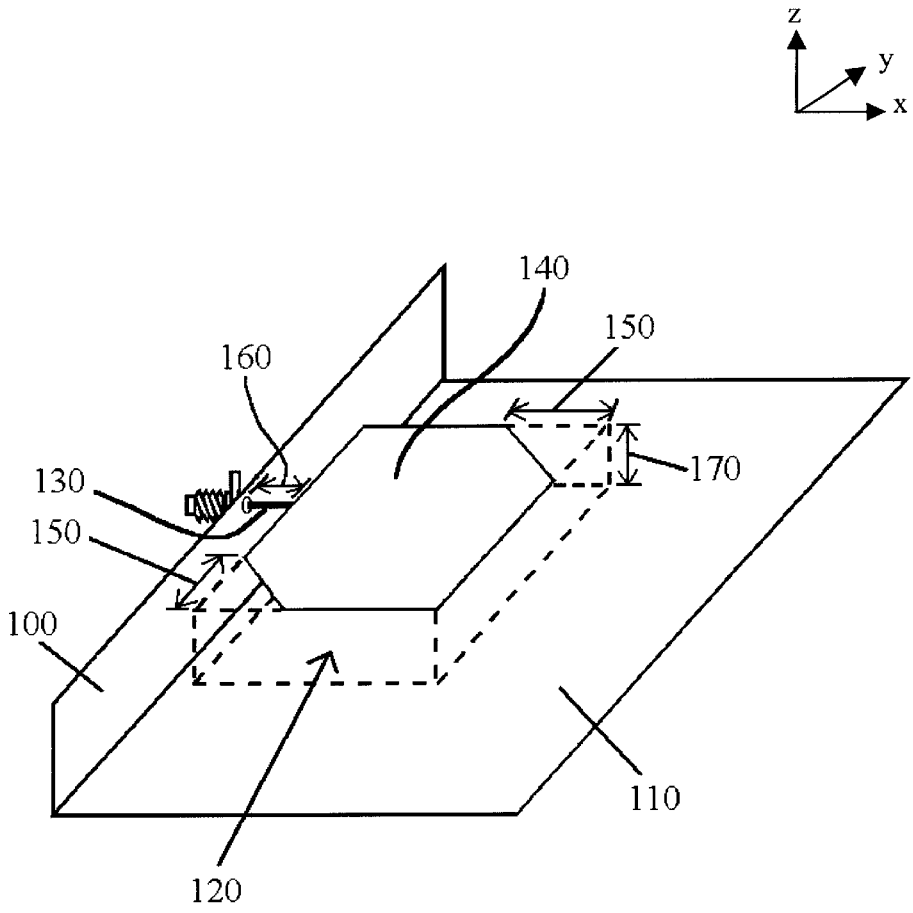
FIG. 3 is a 3D diagram of the structure of an embodiment of the present invention.
Figure 4:
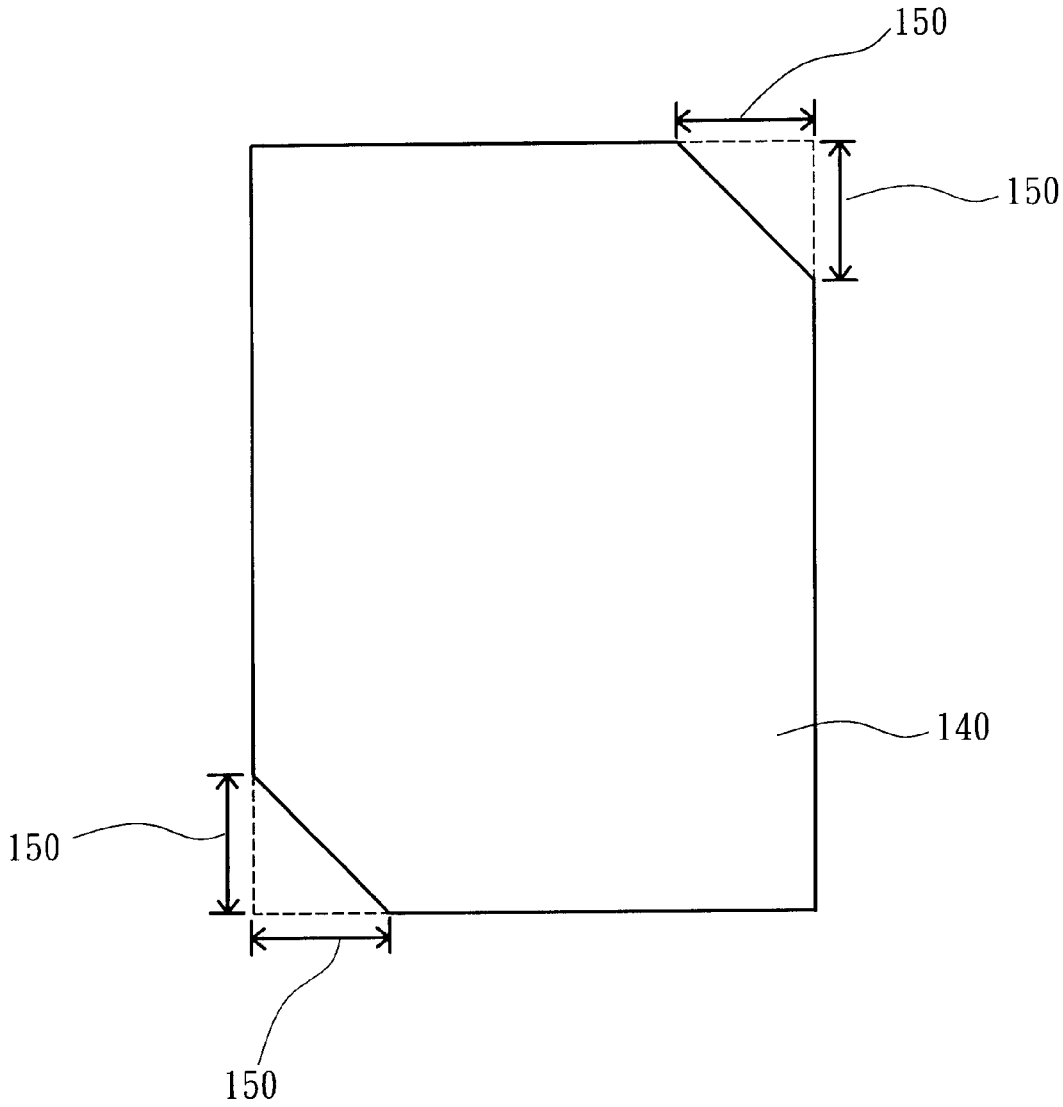
FIG. 4 is a top view of the radiating metal patch of the embodiment of the present invention.

The broadband circularly polarized patch antenna of the present invention has a simple structure, and the feeding method of the present invention is different from that of the conventional circularly polarized patch antennas. Referring to FIG. 3, FIG. 3 shows a 3D diagram of the structure of an embodiment of the present invention. As shown in FIG. 3, the ground plane of the present invention is L-shaped, and consists of a vertical metal ground plane 100 and a horizontal metal ground plane 110. In the embodiment of FIG. 3, the size of the vertical metal ground plane 100 is about 200×23 $mm^2$, and the size of the horizontal metal ground plane 110 is about 200×100 $mm^2$. Moreover, The medium of the substrate 120 is air and the thickness of the substrate 120 is 18 mm; the length of the probe feed 130 is 3.5 mm; the radiating metal patch 140 is a square radiating metal patch with 43×43 $mm^2$; and the side length of the truncated corners 150 of the radiating metal patch 140 is 3.1 mm. Referring to FIG. 4, FIG. 4 shows a top view of the radiating metal patch of the embodiment of the present invention.

A probe feed 130 shown in FIG. 3 is placed coplanarly with a radiating metal patch 140, and is different from the conventional probe feed connected to the radiating metal patch through the substrate. For the conventional design, the reactance part of input impedance of the antenna will be increased because a longer probe feed connected with the radiating metal patch through the substrate is required for a thicker substrate, so that the impedance matching of the antenna is affected and the operating bandwidth of the antenna is reduced. In the broadband circularly polarized patch antenna of the present invention, the probe feed 130 is placed coplanarly with the radiating metal patch 140 and is not connected to the radiating metal patch 140 through the substrate 120. Therefore, the length of the probe feed 130 is reduced tremendously and is shorter than the thickness of the substrate 120. Thus, the undesired reactance contributed from the probe feed is decreased, and the impedance matching is enhanced.

Figure 5:
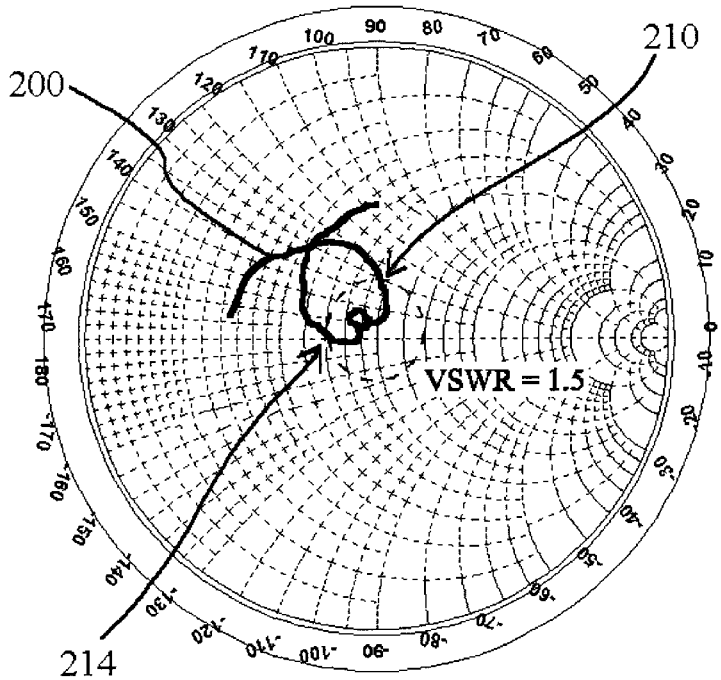
FIG. 5 is a diagram showing measured input impedance, in a Smith chart, of an embodiment of the present invention.

Referring to FIG. 5, FIG. 5 is a diagram showing measured input impedance, in a Smith chart, of an embodiment of the present invention. The curve 200 shown in FIG. 5 indicates the measured input impedance for the operating frequencies of interest of an embodiment of the present invention. The intersection point 212 of the curve 200 and the dotted circle 210 is the lower frequency (=2270 MHz) of an embodiment of the present invention having a VSWR of 1.5, and an intersection point 214 of the curve 200 and the dotted circle 210 is the higher frequency (=3010 MHz) of an embodiment of the present invention having a VSWR of 1.5.

Figure 6:
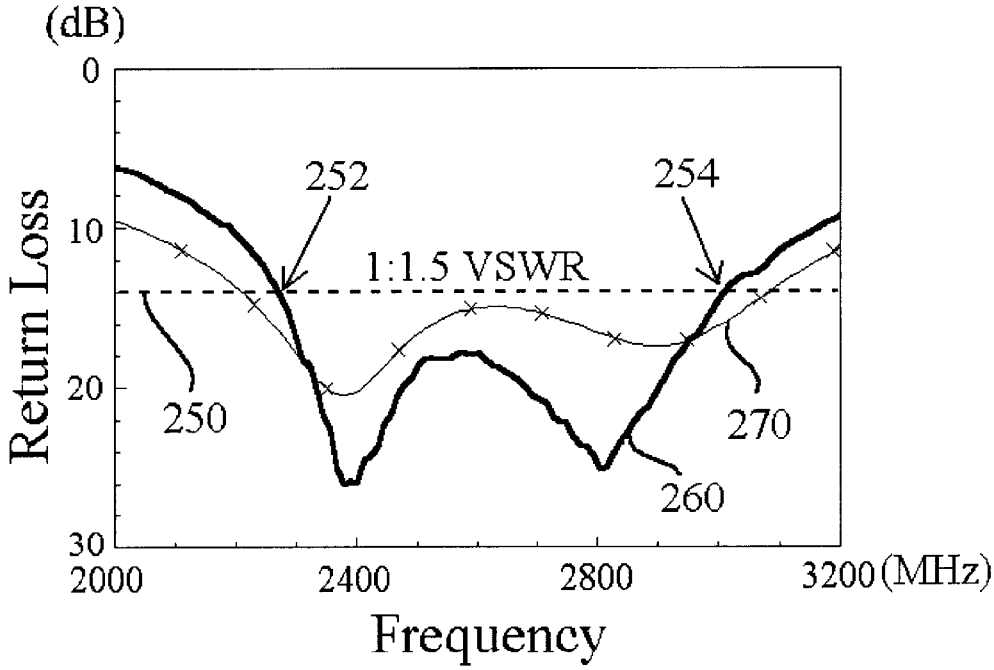
FIG. 6 is a diagram showing measured return loss of an embodiment of the present invention shown in FIG. 3.

Referring to FIG. 6, FIG. 6 is a diagram showing measured return loss of an embodiment of the present invention shown in FIG. 3. The dotted line 250 is a reference line representing a 14 dB return loss or 1:1.5 VSWR. The curve 260 represents the data of an embodiment of the present invention actually measured, and the curve 270 stands for the simulated data of an embodiment of the present invention using an electromagnetic simulation software named HFSS. As shown in FIG. 6, the measured data shown by the curve 260 is similar to the simulated data shown by the curve 270.

When referenced to the dotted line 230, the intersection point 252 and the intersection point 254 of the curve 260 and the dotted line 250 are located at 2270 MHz and 3010 MHz respectively. When the embodiment of the present invention is operated in a range from 2270 MHz to 3010 MHz, the return loss is better than 14 dB or 1:1.5 VSWR. This indicates that the impedance bandwidth of the embodiment of the present invention is about 30% (defined by 1:1.5 VSWR), so that it can be known that the embodiment of the present invention has a wide operating bandwidth.

Figure 7:
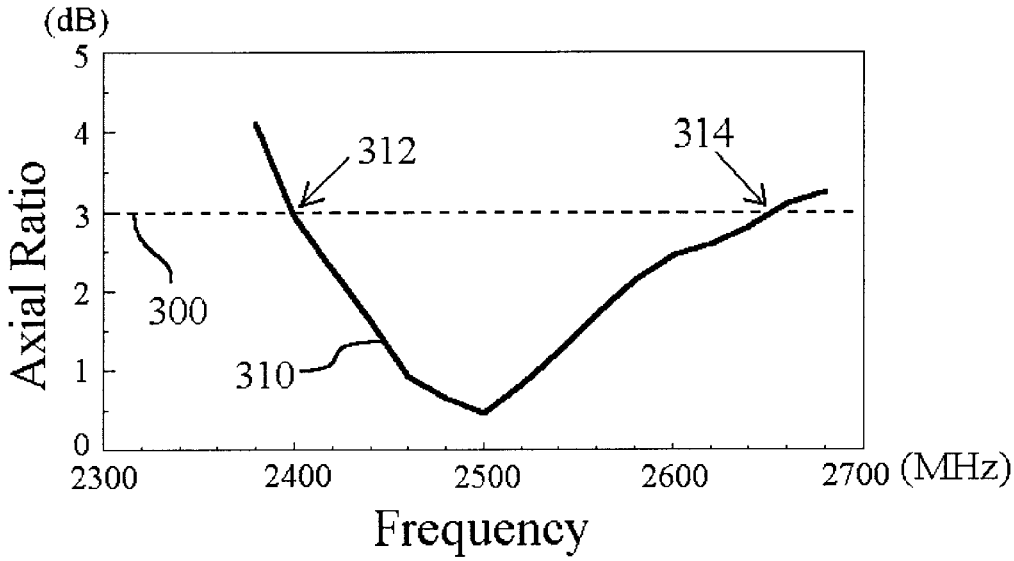
FIG. 7 is a diagram showing measured circular polarization axial ratio of an embodiment of the present invention shown in FIG. 3.

Referring to FIG. 7, FIG. 7 is a diagram showing measured circular polarization axial ratio of an embodiment of the present invention. The dotted line 300 shown in FIG. 7 stands for a 3-dB axial-ratio reference. The intersection point 312 and the intersection point 314 of the curve 310 and the dotted line 300 are located at 2400 MHz and 2660 MHz, respectively. When the central frequency of an embodiment of the resent invention is at about 2500 MHz, the 3-dB axial-ratio circular polarization bandwidth can achieve 10.4% (=[(2660 MHz−2400 MHz)/2500 MHz]×100%). The 3-dB axial-ratio circular polarization bandwidth of the present invention is thus much greater than the 3-dB axial-ratio circular polarization bandwidth of the conventional single-feed circularly polarized patch antenna.

Figure 8:
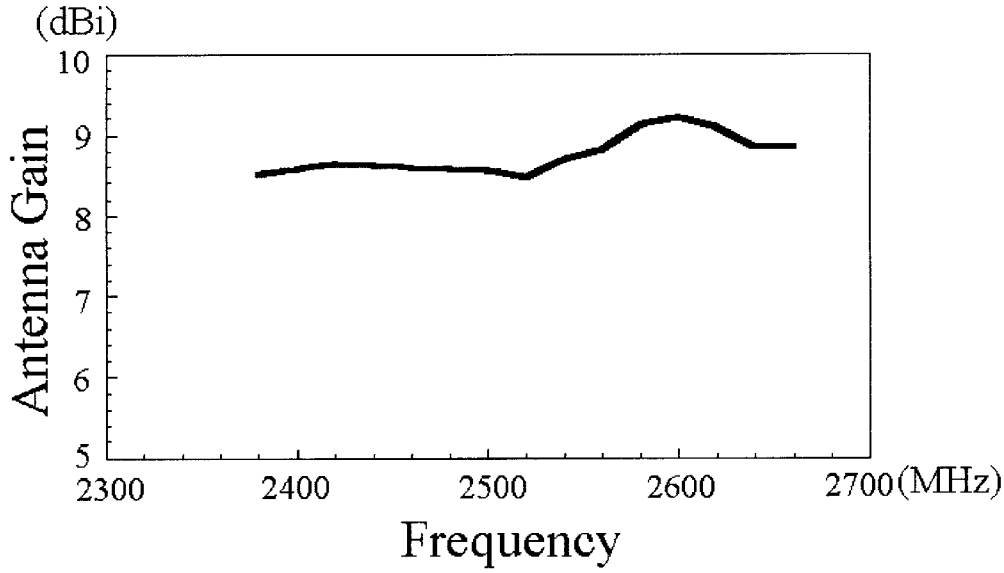
FIG. 8 is a diagram showing measured antenna gain of an embodiment of the present invention shown in FIG. 3.

Referring to FIG. 8, FIG. 8 is a diagram showing measured antenna gain of an embodiment of the present invention shown in FIG. 3. When the embodiment of the present invention is operated in a range from 2380 MHz to 2660 MHz, the antenna gain is better than 8.5 dBi.

Figure 9:
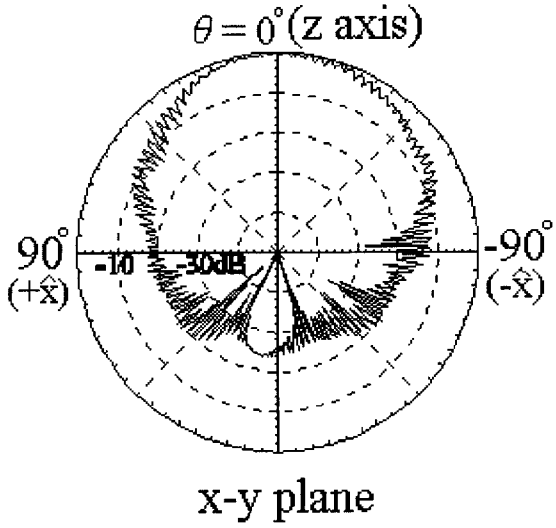
FIG. 9 is a diagram showing measured spinning linear radiation pattern in x-z plane when the embodiment of the present invention shown in FIG. 3 operated at 2450 MHz.
Figure 10:
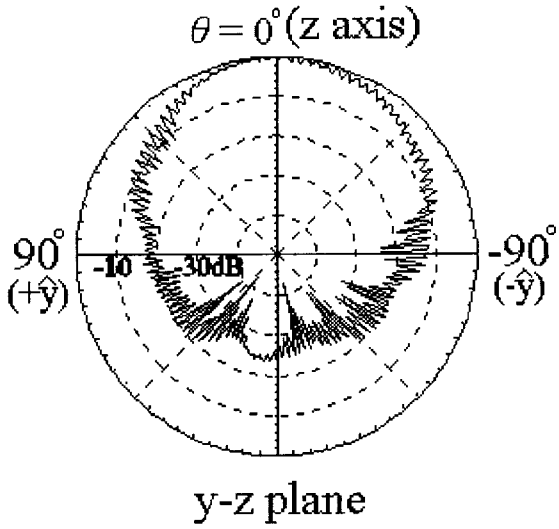
FIG. 10 is a diagram showing measured spinning linear radiation pattern in y-z plane when the embodiment of the present invention shown in FIG. 3 operated at 2450 MHz.

Referring to FIG. 3, FIG. 9 and FIG. 10 at the same time, FIG. 9 is a diagram showing measured spinning linear radiation pattern in x-z plane when the embodiment of the present invention shown in FIG. 3 operated at 2450 MHz. FIG. 10 is a diagram showing measured spinning linear radiation pattern in y-z plane when the embodiment of the present invention shown in FIG. 3 operated at 2450 MHz. As shown in FIG. 9 and FIG. 10, good circular polarization radiation is seen. Therefore, the present invention is suitable for use in wireless LAN and wireless communications for circular polarization operation, so that the implementation is valuable in industrial fields.

Figure 11:
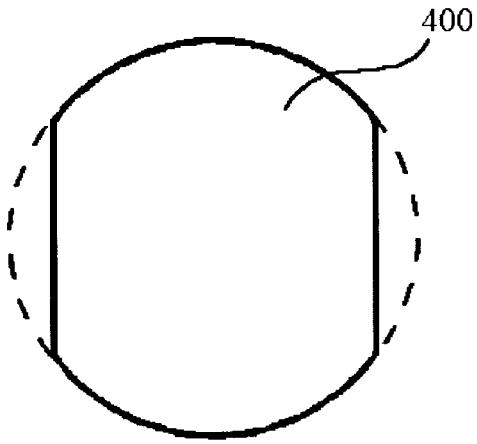
FIG. 11 to FIG. 14 are the top views of radiating metal patches of the other embodiments of the present invention.
Figure 12:
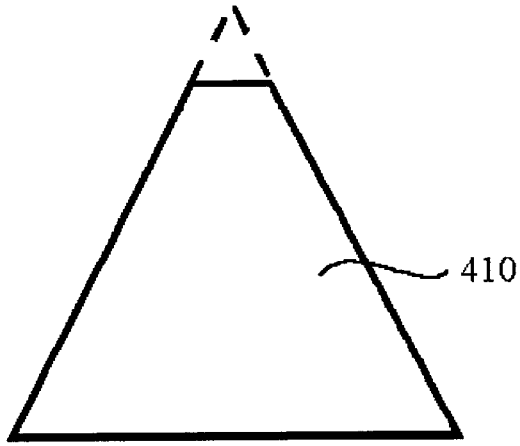
Figure 13:
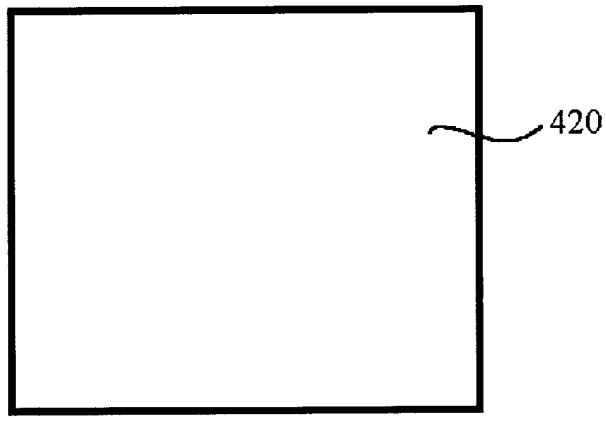
Figure 14:
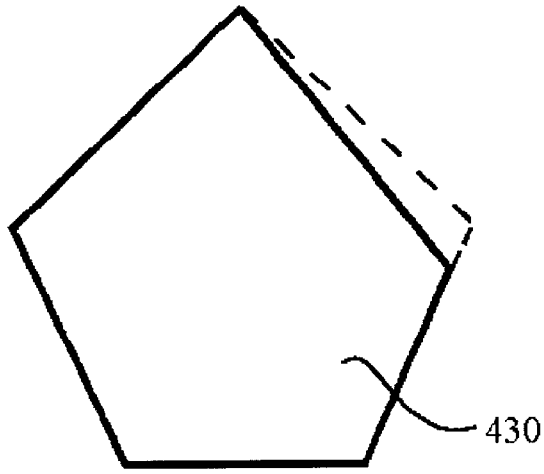

FIG. 11 to FIG. 14 show the top views of radiating metal patches of the other embodiments of the present invention. FIG. 11 shows a circular metal patch 400 with a peripheral cut. FIG. 12 shows a triangular metal patch with a truncated tip 410. FIG. 13 shows a nearly square metal patch 420. FIG. 14 shows a metal patch 430 similar to a pentagon.

The advantage of the present invention is to provide a broadband circularly polarized patch antenna. By using a probe feed placed coplanarly with the radiating metal patch and connected to the radiating metal patch through the vertical metal ground plane of the L-shaped ground plane, the signal is fed to the radiating metal patch directly. Therefore, the length of the probe feed is reduced, and the inductance contributed from the probe feed is smaller, and the impedance bandwidth of the antenna is increased. Moreover, according to the measured data, it is known that the broadband circularly polarized patch antenna of the present invention has wider impedance bandwidth, wider 3-dB axial-ratio circular polarization bandwidth and higher antenna gain. In addition, the structure of the broadband circularly polarized patch antenna of the present invention is simple, so that the construction cost is lower and the present invention is thus a valuable implementation in industrial fields.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A broadband circularly polarized patch antenna, comprising:

a ground plane, which is composed of a vertical ground plane and a horizontal ground plane;

a radiating metal patch;

a probe feed, which is placed coplanarly with the radiating metal patch, and connected to the radiating metal patch through the vertical ground plane, and has a length; and a substrate, which is located between the radiating metal patch and the horizontal ground plane and has a thickness.

2. The broadband circularly polarized patch antenna of claim 1, wherein the vertical ground plane is a vertical metal ground plane.

3. The broadband circularly polarized patch antenna of claim 1, wherein the horizontal ground plane is a horizontal metal ground plane.

4. The broadband circularly polarized patch antenna of claim 1, wherein the substrate is air.

5. The broadband circularly polarized patch antenna of claim 1, wherein the radiating metal patch is a square radiating metal patch with two opposite corners truncated.

6. The broadband circularly polarized patch antenna of claim 1, wherein the radiating metal patch is a circular metal patch with a peripheral cut.

7. The broadband circularly polarized patch antenna of claim 1, wherein the radiating metal patch is a triangular metal patch with a truncated tip.

8. The broadband circularly polarized patch antenna of claim 1, wherein the radiating metal patch is a nearly square metal patch.

9. The broadband circularly polarized patch antenna of claim 1, wherein the radiating metal patch is a metal patch similar to a pentagon.

10. The broadband circularly polarized patch antenna of claim 1, wherein the radiating metal patch can provide circular polarization operation.

11. The broadband circularly polarized patch antenna of claim 1, wherein the length of the probe feed is shorter than the thickness of the substrate.

12. A broadband circularly polarized patch antenna, comprising:

an L-shaped ground plane;

a radiating metal patch;

a probe feed, which is placed coplanarly with radiating metal patch, and has a length; and an antenna substrate, which is located between the radiating metal patch and a horizontal ground plane of the L-shaped ground plane and has a thickness.

13. The broadband circularly polarized patch antenna of claim 12, wherein the L-shaped ground plane is constructed by a vertical ground and the horizontal ground plane.

14. The broadband circularly polarized patch antenna of claim 13, wherein the vertical ground plane is a vertical metal ground plane.

15. The broadband circularly polarized patch antenna of claim 13, wherein the horizontal ground plane is a horizontal metal ground plane.

16. The broadband circularly polarized patch antenna of claim 12, wherein the probe feed is used to connect to the radiating metal patch through the vertical ground plane, and the length of the probe feed is shorter than the thickness of the substrate.

17. The broadband circularly polarized patch antenna of claim 12, wherein the radiating metal patch is selected from a group consisting of a square radiating metal patch with two opposite corners truncated, a circular metal patch with a peripheral cut, a triangular metal patch with a truncated tip, a nearly square metal patch, a metal patch similar to a pentagon and a radiating metal patch that can provide circular polarization operation.

* * * * *